US008081057B2

(12) United States Patent
Chiu

(10) Patent No.: US 8,081,057 B2
(45) Date of Patent: Dec. 20, 2011

(54) CURRENT PROTECTION DEVICE AND THE METHOD FOR FORMING THE SAME

(76) Inventor: Hung-Chih Chiu, Taipei (TW)

( * ) Notice: Subject to any disclaimer, the term of this patent is extended or adjusted under 35 U.S.C. 154(b) by 32 days.

(21) Appl. No.: 12/466,385

(22) Filed: May 14, 2009

(65) Prior Publication Data

US 2010/0289612 A1 Nov. 18, 2010

(51) Int. Cl.
*H01H 85/04* (2006.01)
*H01H 69/02* (2006.01)

(52) U.S. Cl. ..... 337/297; 337/142; 337/290; 337/293; 337/296; 29/623

(58) Field of Classification Search ..... 337/296, 337/290, 293, 297, 142; 29/623
See application file for complete search history.

(56) References Cited

U.S. PATENT DOCUMENTS 4,458,294 A * 7/1984 Womack ..... 361/321.3
4,608,548 A * 8/1986 Borzoni ..... 337/201
4,894,633 A * 1/1990 Holtfreter ..... 337/278
5,095,297 A * 3/1992 Perreault et al. ..... 337/297
5,166,656 A * 11/1992 Badihi et al. ..... 337/297
5,228,188 A * 7/1993 Badihi et al. ..... 29/623
5,296,833 A * 3/1994 Breen et al. ..... 337/297
5,432,378 A * 7/1995 Whitney et al. ..... 257/529
5,606,301 A * 2/1997 Ishimura ..... 337/290
5,621,375 A * 4/1997 Gurevich ..... 337/297
5,642,090 A * 6/1997 Arikawa ..... 337/297
5,726,620 A * 3/1998 Arikawa ..... 337/227
5,726,621 A * 3/1998 Whitney et al. ..... 337/297
5,739,740 A * 4/1998 Stark et al. ..... 337/248
5,926,084 A * 7/1999 Frochte ..... 337/231
5,929,741 A * 7/1999 Nishimura et al. ..... 337/290
6,034,589 A * 3/2000 Montgomery et al. ..... 337/296
6,078,245 A * 6/2000 Fritz et al. ..... 337/297
6,191,928 B1 * 2/2001 Rector et al. ..... 361/127
6,710,699 B2 * 3/2004 Kaltenborn et al. ..... 337/297
7,367,114 B2 * 5/2008 Rybka et al. ..... 29/623
2003/0076214 A1 * 4/2003 Ackermann ..... 337/296
2006/0232910 A1 * 10/2006 Megherhi et al. ..... 361/321.4
2007/0075822 A1 * 4/2007 Pachla et al. ..... 337/297
2008/0191336 A1 * 8/2008 Tsai ..... 257/682
2008/0191832 A1 * 8/2008 Tsai ..... 337/297
2008/0218935 A1 * 9/2008 Symes et al. ..... 361/301.4
2009/0102595 A1 * 4/2009 Pachla et al. ..... 337/297

* cited by examiner

*Primary Examiner* — Bradley Thomas
(74) *Attorney, Agent, or Firm* — Leong C. Lei

(57) ABSTRACT

A current protection device comprises a substrate having an upper portion and a lower portion; a fusing layer installed between the upper portion and the lower portion; ends of the fusing layer exposed from the substrate; a cavity formed near surfaces of the fusing layer for providing a space to receive the fusing layer as the fusing layer fuses; and an end electrode having three layers including a silver thin layer, a nickel thin layer and a tin thin layer; the end electrode being formed as a conductive electrode. The method for forming the same is provided.

4 Claims, 12 Drawing Sheets

CURRENT PROTECTION DEVICE AND THE METHOD FOR FORMING THE SAME

FIELD OF THE INVENTION

The present invention relates to current protection elements, and in particular to a current protection device formed by a substrate, a cavity, fusing layer, and end electrodes which is suitable to protect a circuit with various currents.

BACKGROUND OF THE INVENTION

The conventional fuse is used to electronic products. If the current past is too large, the fused portion will fuse so as to prevent the circuit to short-circuit. Moreover, with the requirement of compact size and light weight of the electronic products, more and more parts are necessary and more and more elements must be installed on the circuit board. The wires on the boards become more and more small-sized. The circuit protection also has a trend of small size and high rated current and thus the effect of electric arc can not be prevented.

Moreover, some fuses are made integrally. Referring to FIG. 1, a prior art fuse is illustrated, which is illustrated in U.S. Pat. No. 6,034,589 and applied to a surface mounting fuse chip 100, wherein a plurality of layers and fuses are used. In U.S. Pat. No. 7,268,661, a protection element of large current is disclosed, in that the material of the fuse and electric arc preventing material are discussed. In U.S. Pat. No. 5,726,621, a ceramic material with surface mounting protection circuit is disclosed. The structure and process of the fuse is disclosed. The current technology uses integral forming method. The fuses are limited by the uniformity of the ceramic powder and the temperature distribution in the fuse area so that the reliability is low.

The disadvantages of the prior art will be described herein. The fuse is formed integrally, the uniformity of ceramic powders used will affect the temperature distribution thereof so that the reliability is bad and it is not safe. The current fuse has a large size and a small rated current so that it is not suitable for the trend of compact size and light weight. Thus it can not match the requirement of market. The current fuse has a multilayer structure with a large resistance. The manufacturing process is complicated with a high cost and more material used. The yield ratio is low. The electric arc from the prior art fuse will affect the safety of the circuit, even an expensive device will be destroyed or burnt.

SUMMARY OF THE INVENTION

The object of the present invention is to provide a current protection device and a method for forming the same wherein the cavity serves for providing a space of receiving fused fusing layer.

Another object of the present invention is to provide a current protection device, wherein the anti-electric arc layer serves to absorb the electric arc as the fuse breaks to protect the circuit.

A further object of the present invention is to provide a current protection device, wherein the middle layer can be not installed or at least one middle layers are installed so as to increase the rated current.

A yet object of the present invention is to provide a current protection device, wherein the device has a higher efficiency, low cost and light volume.

To achieve above object, the present invention provides a current protection device comprising a substrate having an upper portion and a lower portion; a fusing layer installed between the upper portion and the lower portion; ends of the fusing layer exposed from the substrate; a cavity formed near surfaces of the fusing layer for providing a space to receive the fusing layer as the fusing layer fuses; and an end electrode having three layers including a silver thin layer, a nickel thin layer and a tin thin layer; the end electrode being formed as a conductive electrode.

The various objects and advantages of the present invention will be more readily understood from the following detailed description when read in conjunction with the appended drawing.

DETAILED DESCRIPTION OF THE INVENTION

Figure 1:
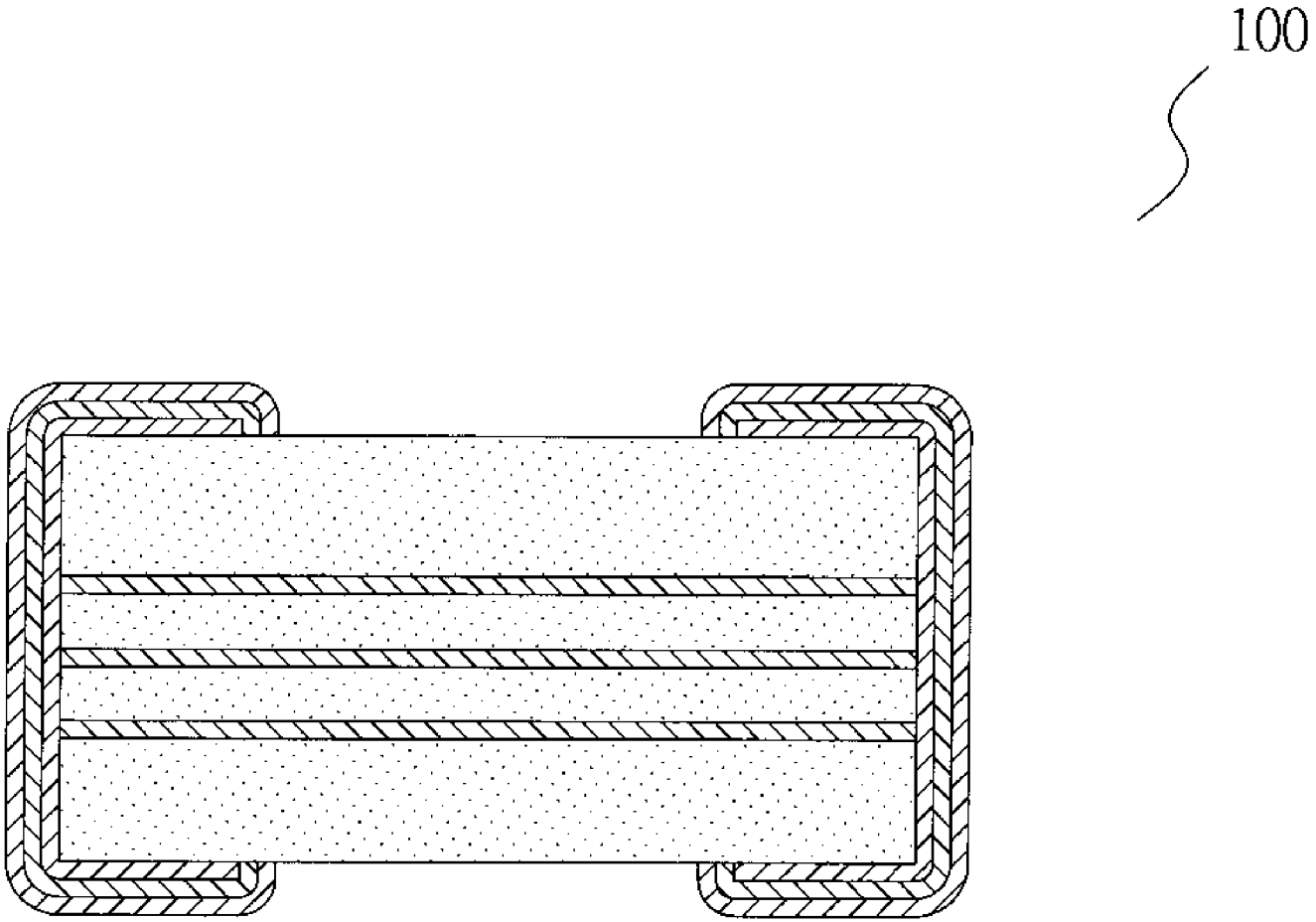
FIG. 1 is a schematic view of the prior art fuse.
Figure 2:
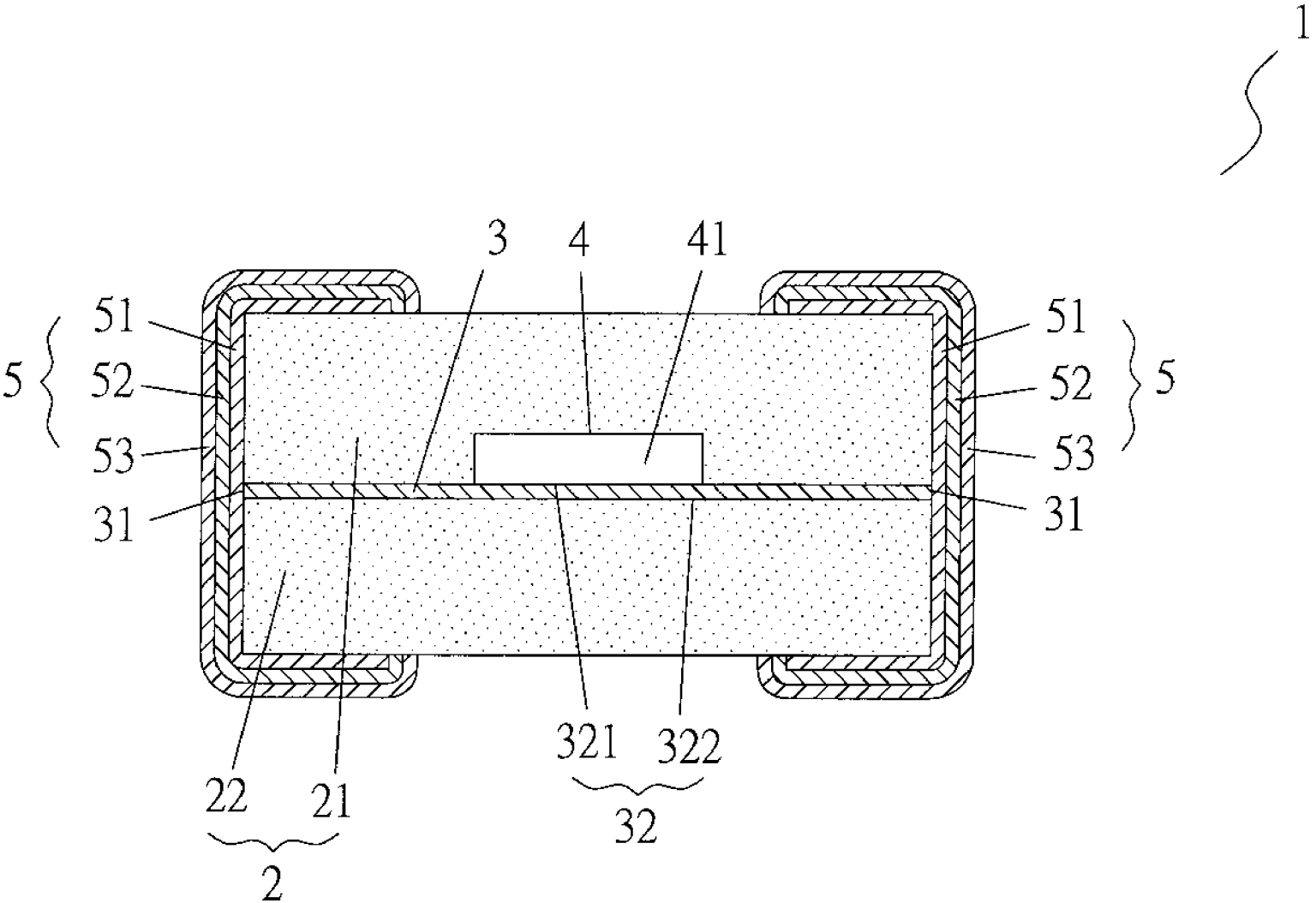
FIG. 2 is a schematic view about the first embodiment of the present invention.
Figure 3:
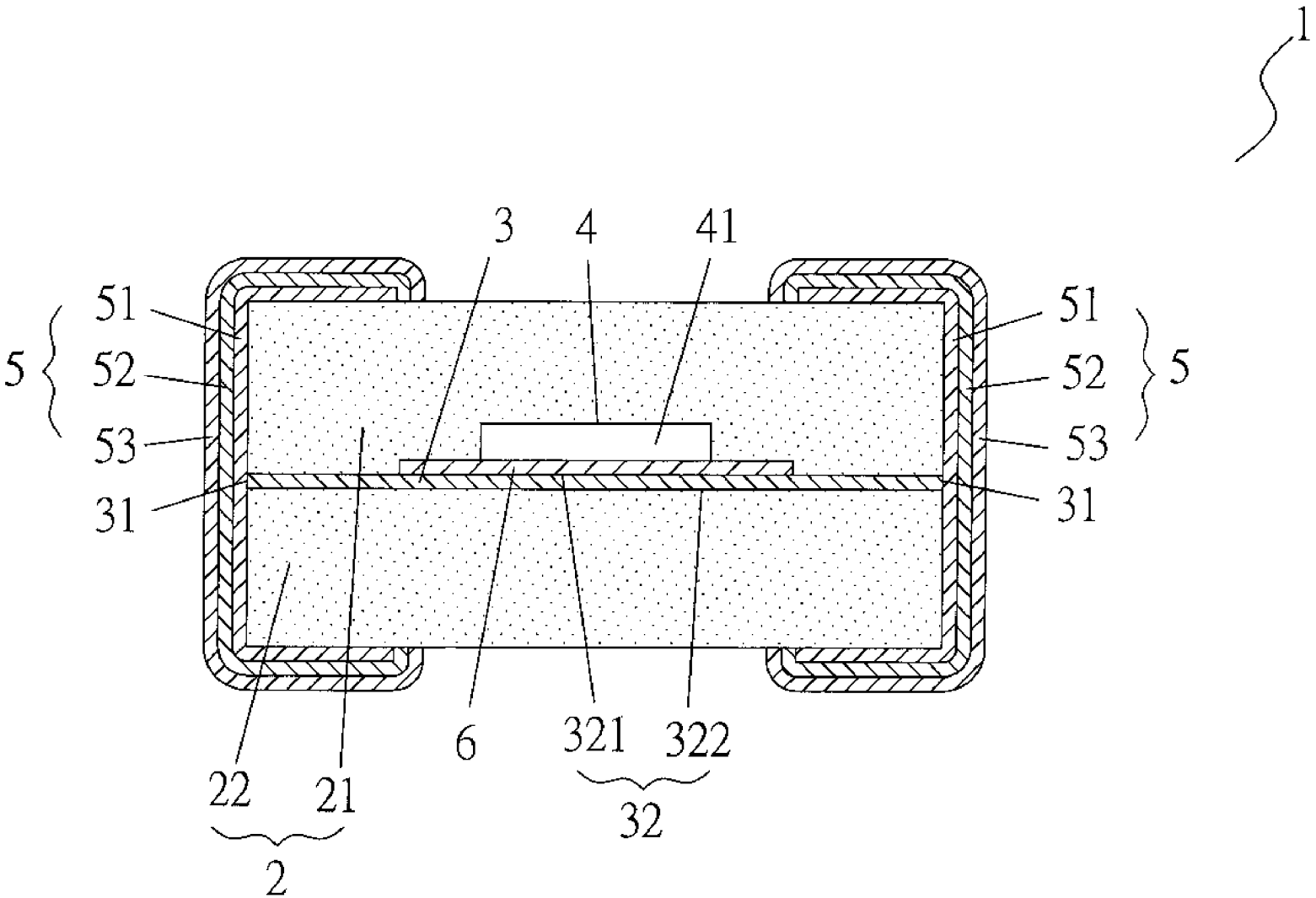
FIG. 3 is a schematic view about the second embodiment of the present invention.
Figure 4:
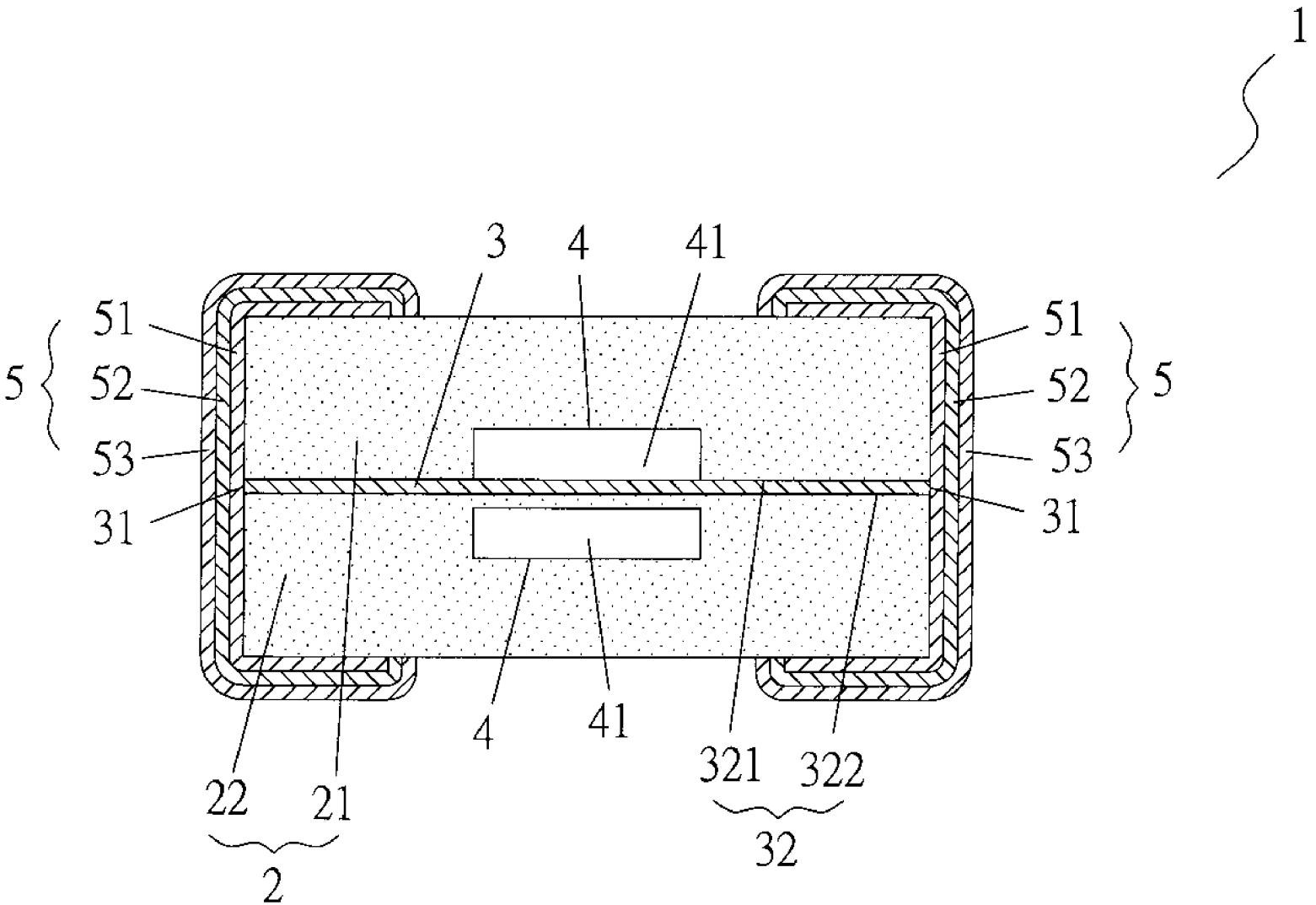
FIG. 4 is a schematic view about the third embodiment of the present invention.
Figure 5:
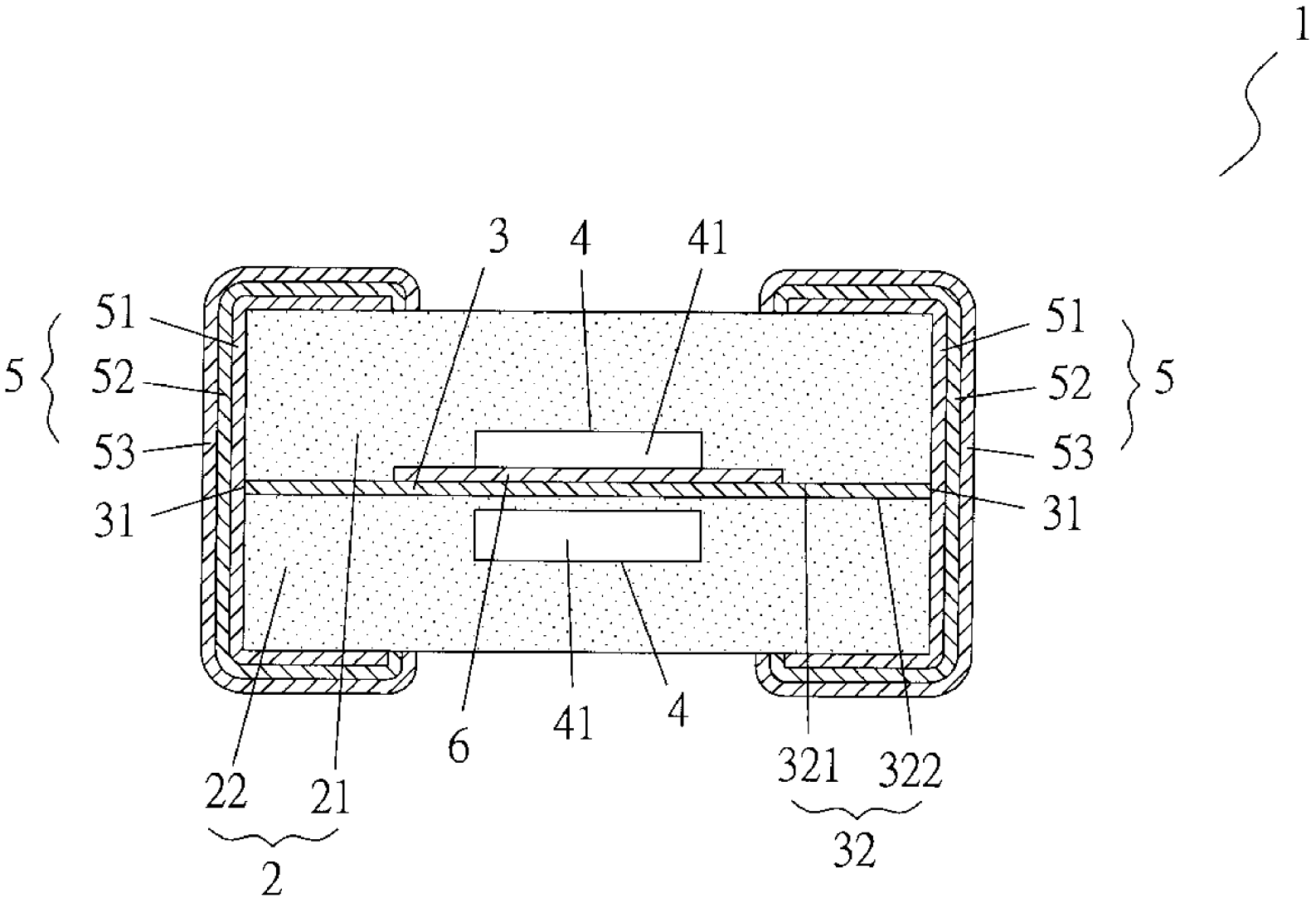
FIG. 5 is a schematic view about the fourth embodiment of the present invention.
Figure 6:
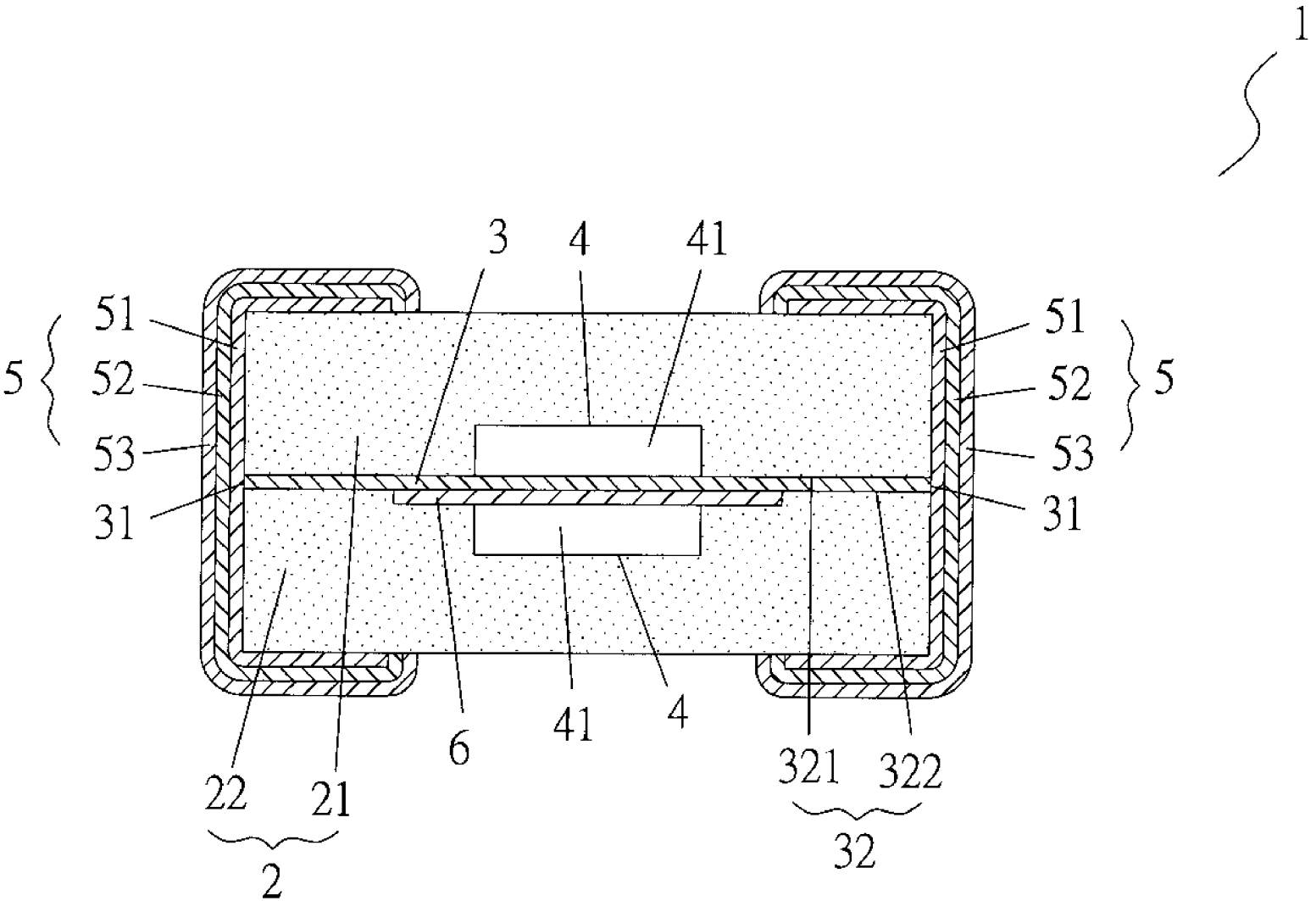
FIG. 6 is a schematic view about the fifth embodiment of the present invention.
Figure 7:
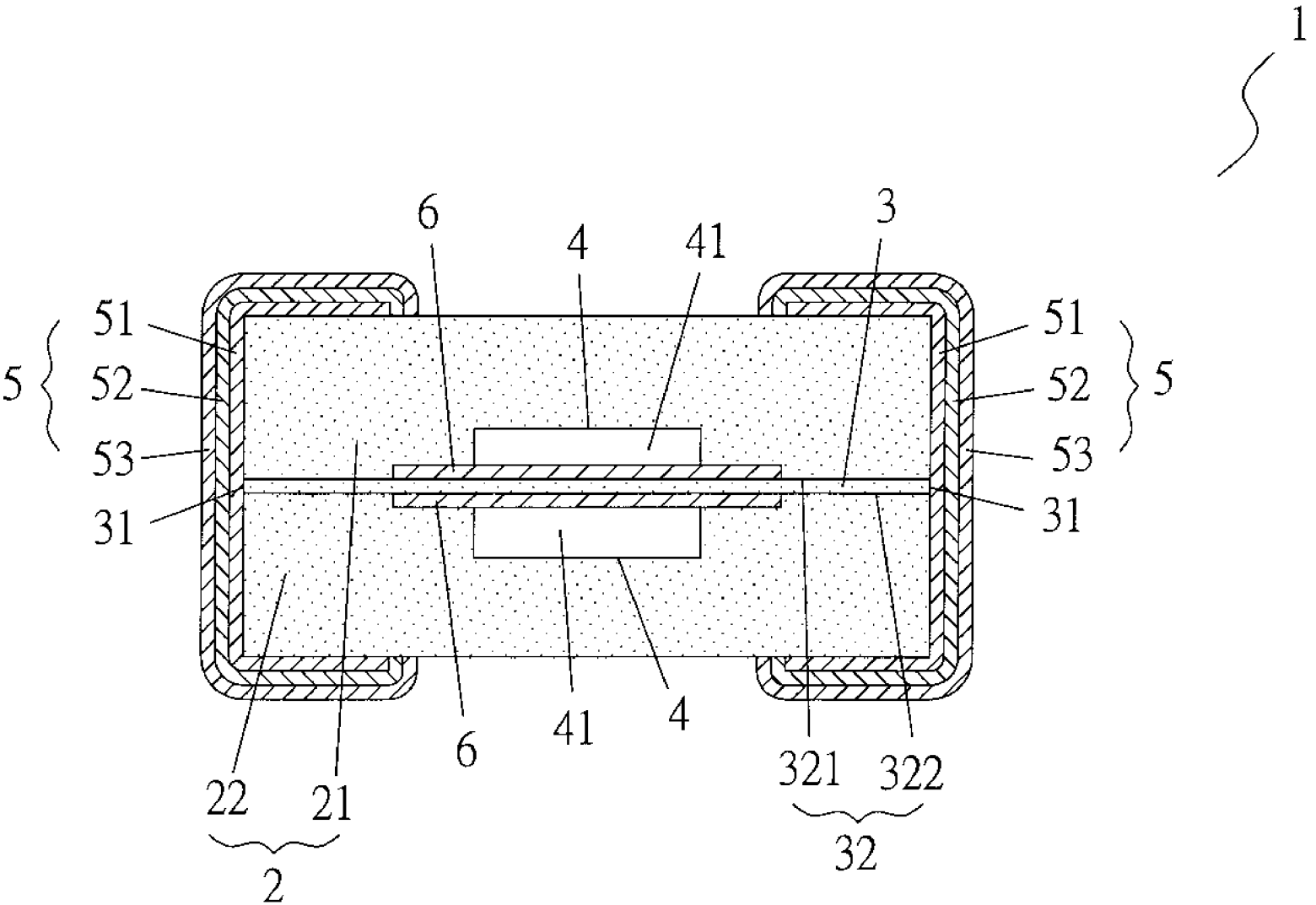
FIG. 7 is a schematic view about the sixth embodiment of the present invention.
Figure 8:
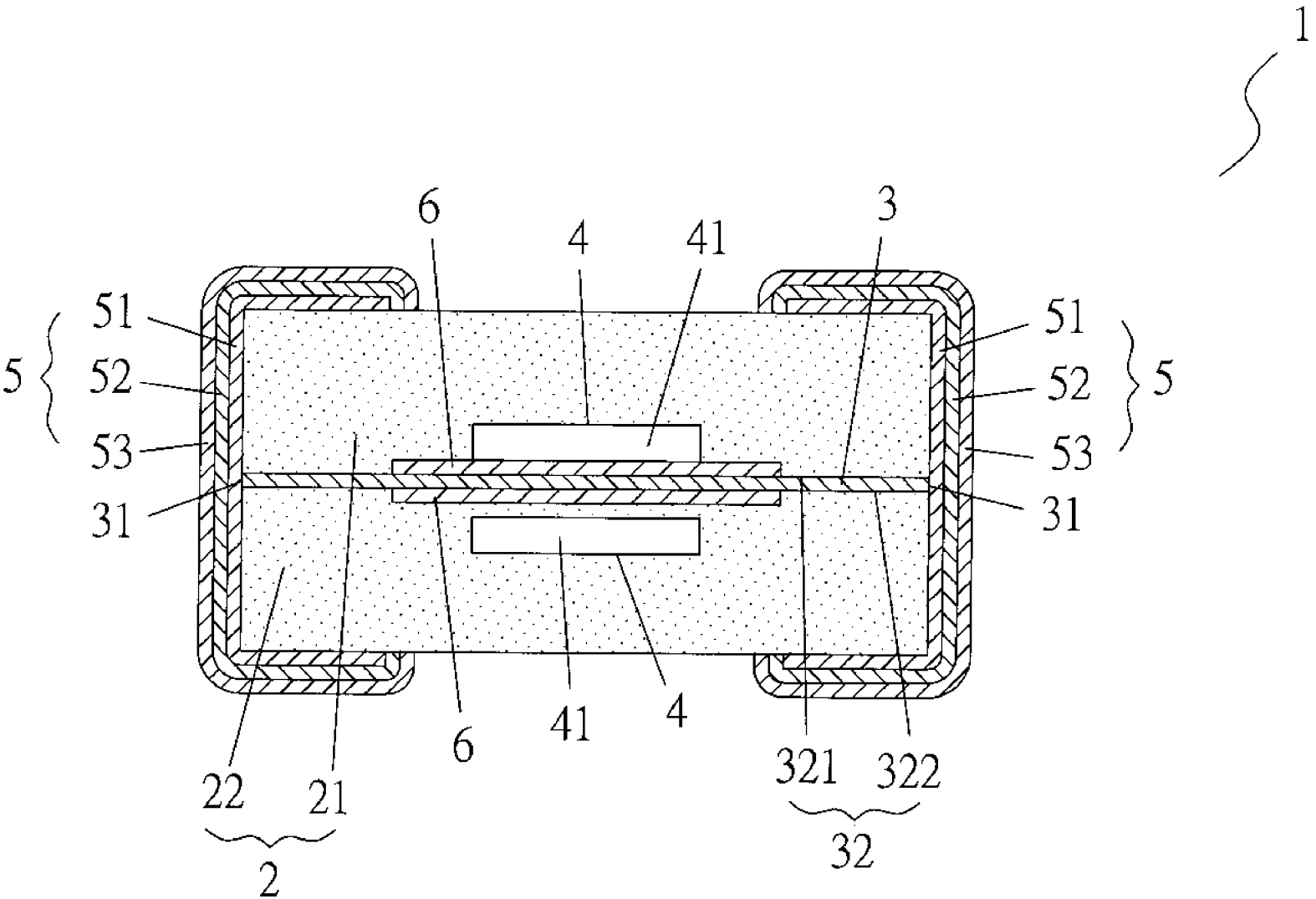
FIG. 8 is a schematic view about the seventh embodiment of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 2 to 12, the first to tenth embodiments of the present invention are illustrated. The present invention relates to a current protection device which is formed by a substrate 2, a fusing layer 3, a cavity 4 and an end electrode 5. The substrate 2 is divided into an upper portion 21 and a lower portion 22 as an upper base and lower base of the end element 1.

The fusing layer 3 is clamped between the upper portion 21 and lower portion 22 of the substrate 2. An outer edge thereof is exposed from the substrate 2.

The cavity 4 is formed on the surface 32 of the fusing layer 3 so as to provide a space 41 for the breakage of the fusing layer 3.

The end electrode 5 has three layers, one silver thin layer 51, one nickel thin layer 52 and one tin thin layer 53. The end electrode 5 is installed at an edge of the substrate 2 so as to form as a conductive electrode.

In realization of the present invention, the element 1 further includes at least one anti-electric arc layer 6 which is installed on the fusing layer 3 so as to prevent the electric arc as the fusing layer 3 is fused (as shown in FIGS. 3, 5, 8, 10 and 11). Another material of the substrate 2 is selected from glass, Ca—B—Si ceramic, glass mixed with Al2O3 or material formed through lower temperature sintering process. In lower temperature sintering process, the densification temperature is lower than 1000.degree. C. The fusing layer 3 is selected from silver, copper, aluminum, gold, or the alloy or mixing of above elements. The cavity 4 is a volume smaller than that of the fusing layer 3 and is installed near the fusing layer 3 so as to provide a space for the fusing of the fusing layer 3. The material of the anti-electric arc layer 6 is selected from glass, glass mixed metal oxide or material formed through the process of lower temperature sintering with a temperature lower than 1000.degree. C.

Figure 9:
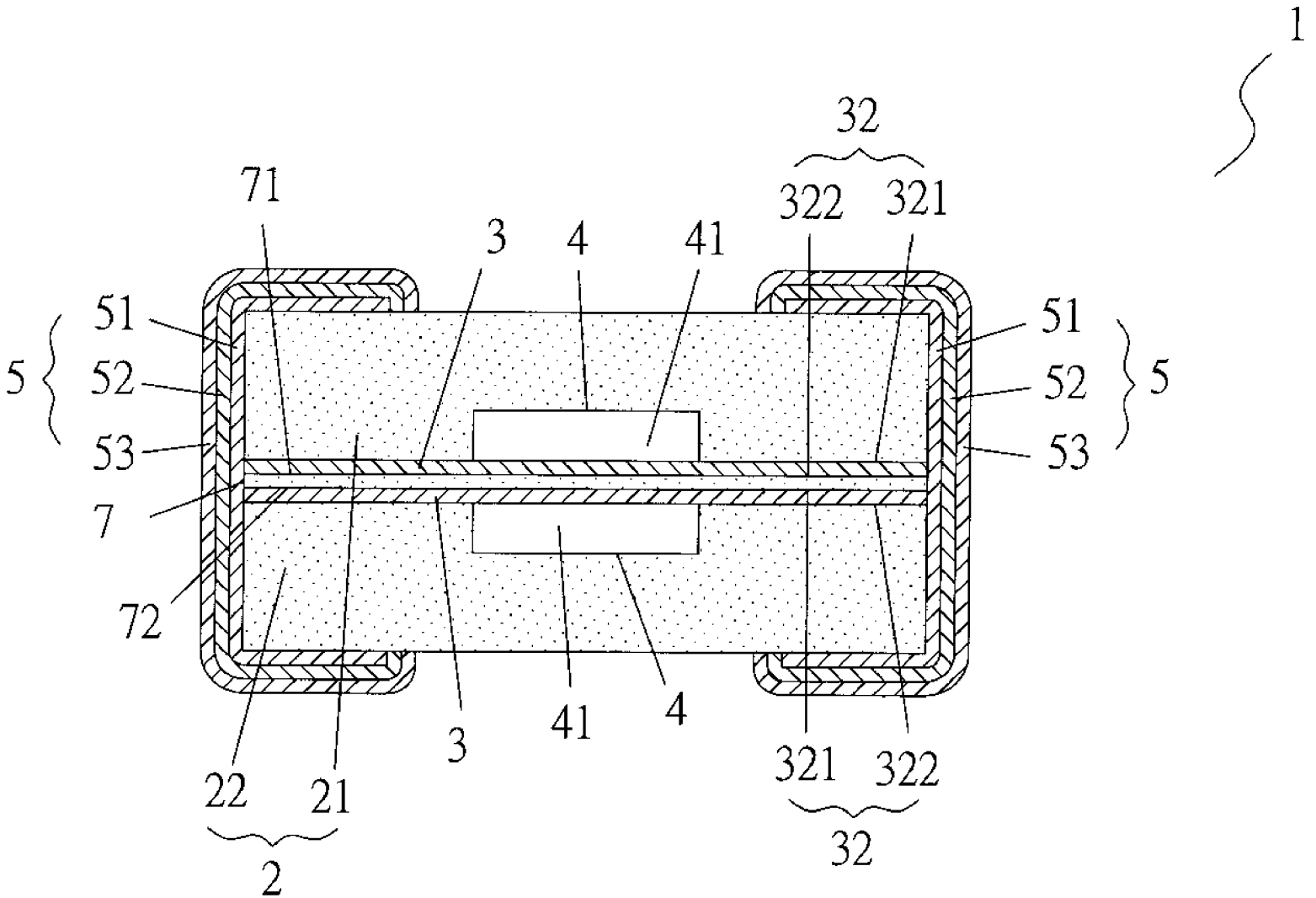
FIG. 9 is a schematic view about the eighth embodiment of the present invention.
Figure 10:
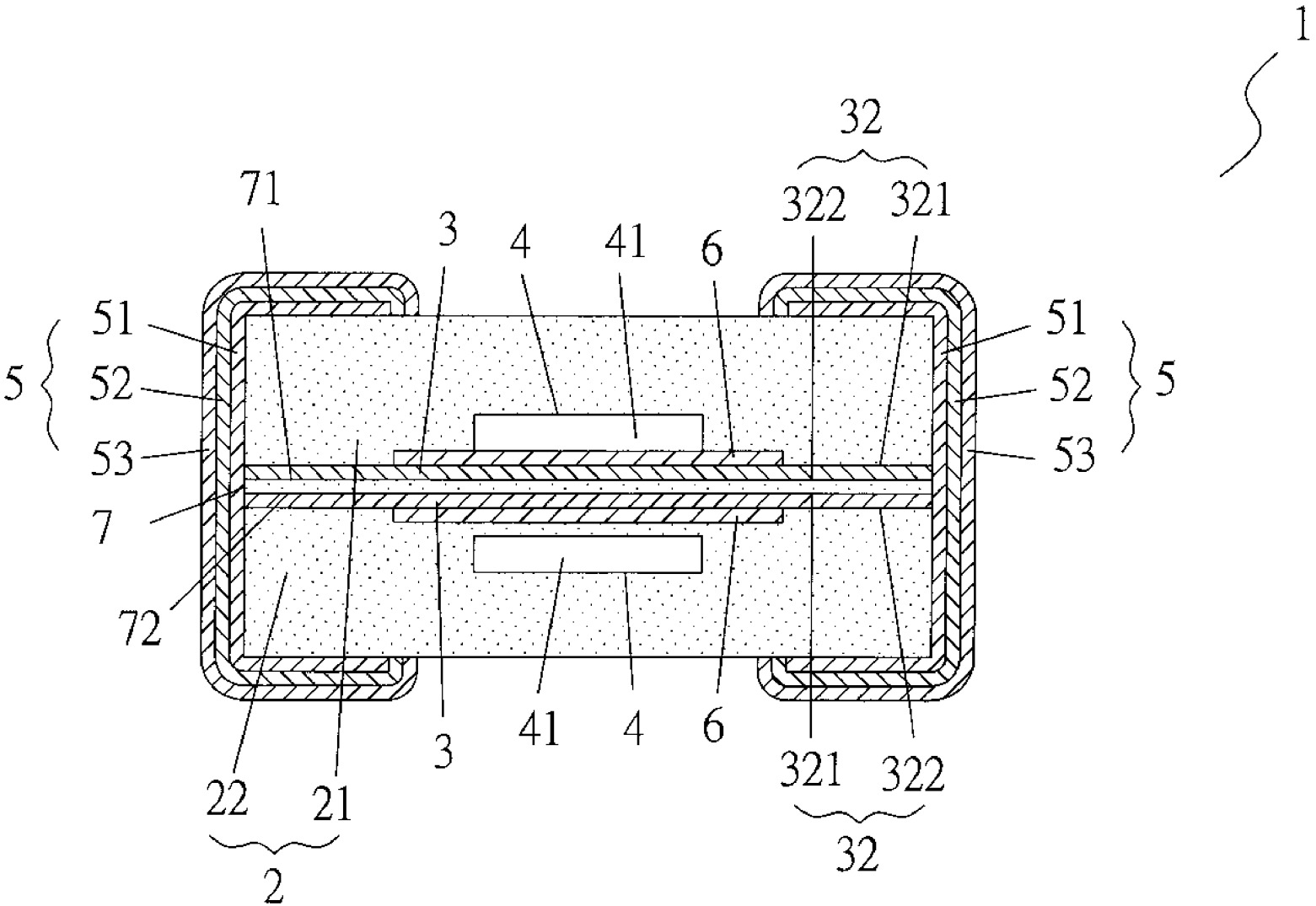
FIG. 10 is a schematic view about the ninth embodiment of the present invention.
Figure 11:
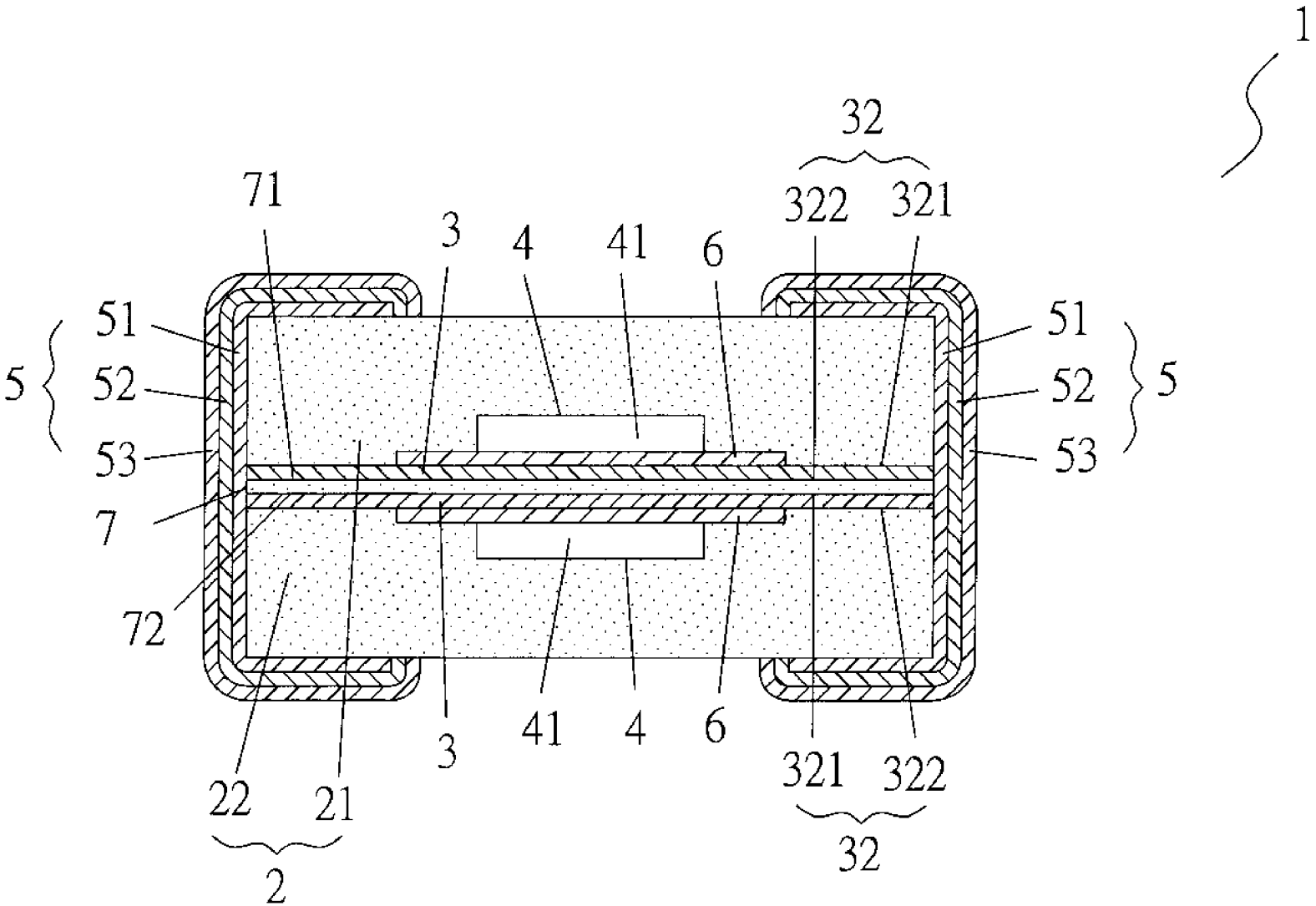
FIG. 11 is a schematic view about the tenth embodiment of the present invention.
Figure 12:
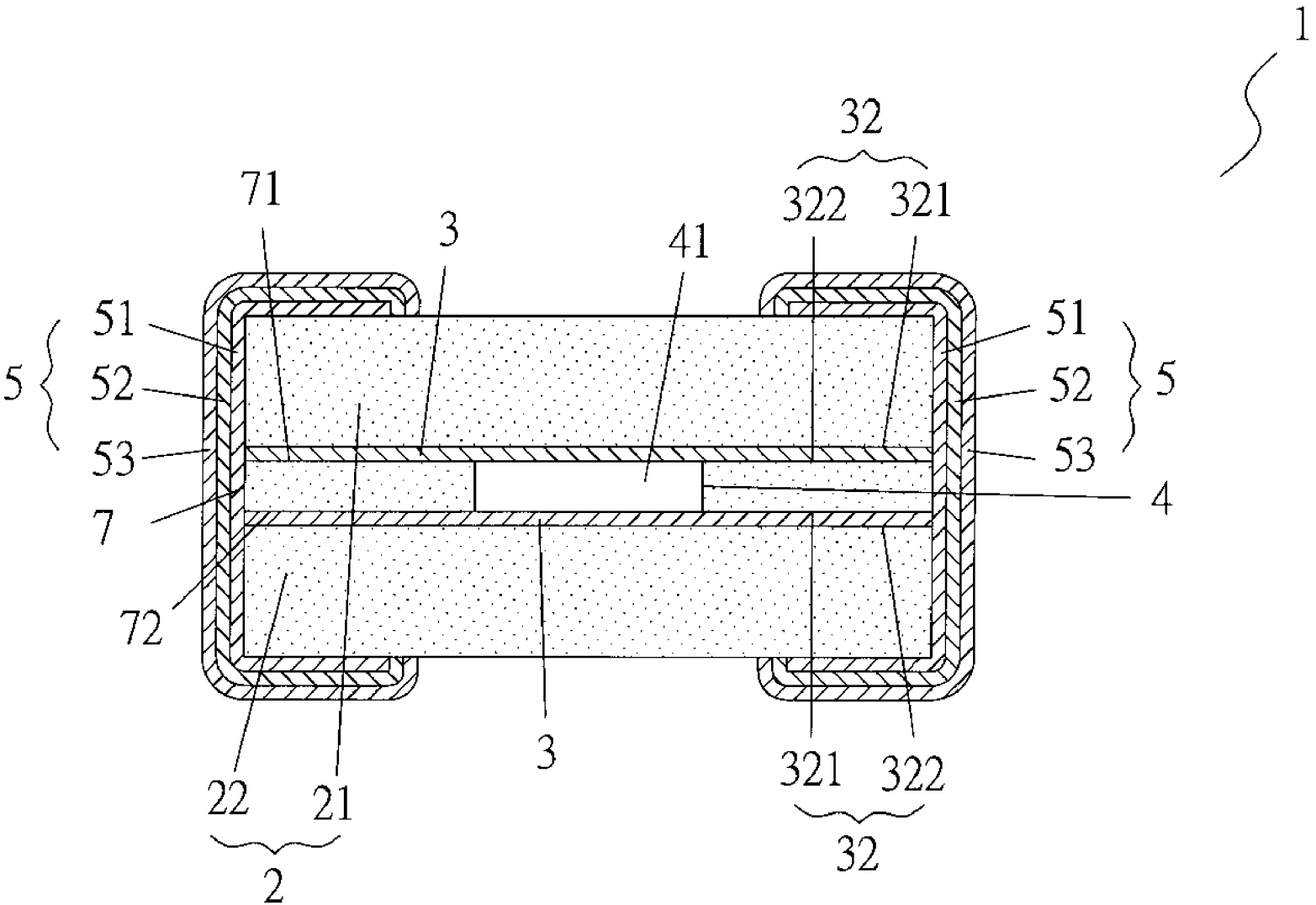
FIG. 12 is a schematic view about the eleventh embodiment of the present invention.

In another embodiment of the present invention, a middle layer 7 is formed between the upper portion 21 and the lower portion 22. A fusing layer 3 is installed between the upper surface 72 of the middle layer 7 and the upper portion 21 and another fusing layer 3 is installed between the lower surface 72 of the middle layer 7 and the lower portion 22 so as to enlarge the rated current (as shown in FIGS. 9 to 11). The middle layer 7 is formed in the cavity 4 near the fusing layer 3 so as to provide a space for the fusing of the fusing layer 3.

Furthermore, those skilled in the art must know that in the first embodiment, for a current protection element with one or plurality of layers of end electrodes 5, there may be a plurality of middle layers 7 for installation of a plurality of fusing layers 3. so as to increase the rated current to have the effect of current protection.

Next, the manufacturing process for the current protection element of the present invention will be described herein. The process comprises the steps of providing a substrate 2, forming an upper portion 21 and a lower portion 22 on the substrate 2; the upper portion 21 or the lower portion 22 is formed with a cavity 4; then forming a fusing layer 3 between the upper portion 21 and the lower portion 22; an end portion of the fusing layer 3 is exposed from the substrate 2; an end electrode 5 is formed to be attached to the end portion; and thus a current protection element with a cavity 4 is formed.

Another, the process for forming the current protection element 1 further comprises the steps of after forming the fusing layer 3, anti-electric are layer 6 is formed on the upper surface 321 or lower surface 322 of the fusing layer 3. Moreover, a middle layer 7 is formed and the fusing layers are formed on an upper surface 71 and lower surface 72 of the middle layer 7. Then the middle layer 7 and the fusing layers 3 are installed between the upper portion 21 and the lower portion 22.

Advantages of the present invention will be described herein. The cavity 4 serves for providing a space of receiving fused fusing layer 3. The anti-electric arc layer 6 serves to absorb the electric arc as the fuse breaks to protect the circuit. The middle layer 7 can be riot installed or at least one middle layers 7 are installed so as to increase the rated current. The present invention has a higher efficiency, low cost and light volume.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A current protection device comprising:

a substrate having an upper portion, a lower portion, and a middle layer between said upper portion and said lower portion;

a first fusing layer installed between said upper portion and said middle layer;

a second fusing layer installed between said lower portion and said middle layer;

a first anti-electric arc layer mounted on an outer surface of said first fusing layer;

a second anti-electric layer mounted on an outer surface of said second fusing layer;

a first cavity which is smaller than said first fusing layer and formed in said upper portion of said substrate and has a first opening which is opposite to a surface of said first anti-electric arc layer, said first opening being smaller than said surface of said first anti-electric arc layer;

a second cavity which is smaller than said second fusing layer and formed in said lower portion of said substrate and has a second opening which is opposite to a surface of said second anti-electric arc layer, said second opening being smaller than said surface of said second anti-electric arc layer;

a first end electrode installed at a first end of said substrate and having a silver layer, a nickel layer and a tin layer; and a second end electrode installed at a second end of said substrate and having a silver layer, a nickel layer and a tin layer.

2. The current protection device as claimed in claim 1, wherein said substrate is formed by one of glasses, Ca—B—Si ceramics, glass mixed with aluminum oxide, and material processed with low temperature sintering.

3. The current protection device as claimed in claim 2, wherein said material processed with low temperature sintering has a temperature of densification smaller than 1000° C.

4. The current protection device as claimed in claim 1, wherein said fusing layers are selected from silver, copper, aluminum, gold or combinations of above elements.

* * * * *